US009081324B2

(12) United States Patent
Asai

(10) Patent No.: US 9,081,324 B2
(45) Date of Patent: Jul. 14, 2015

(54) DEVELOPING DEVICE AND IMAGE FORMING APPARATUS

(71) Applicant: Funai Electric Co., Ltd., Daito-shi, Osaka (JP)

(72) Inventor: Toshinori Asai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/188,963

(22) Filed: Feb. 25, 2014

(65) Prior Publication Data

US 2014/0270860 A1 Sep. 18, 2014

(30) Foreign Application Priority Data

Mar. 12, 2013 (JP) ..... 2013-049578

(51) Int. Cl.

| | |
|---|---|
| ***G03G 15/08*** | (2006.01) |
| ***G03G 21/12*** | (2006.01) |
| ***G03G 21/16*** | (2006.01) |
| ***G03G 21/18*** | (2006.01) |

(52) U.S. Cl.

CPC ..... *G03G 15/0815* (2013.01); *G03G 21/12* (2013.01); *G03G 21/16* (2013.01); *G03G 21/1817* (2013.01)

(58) Field of Classification Search

CPC ..... G03G 15/0815; G03G 21/10
USPC ..... 399/120, 283
See application file for complete search history.

(56) References Cited

U.S. PATENT DOCUMENTS

2009/0103956 A1* 4/2009 Matsui ..... 399/264

FOREIGN PATENT DOCUMENTS

| | | | |
|---|---|---|---|
| JP | 62217278 A | * | 9/1987 |
| JP | 10232556 A | * | 9/1998 |
| JP | 2000-147889 A | | 5/2000 |

* cited by examiner

*Primary Examiner* — Erika J Villaluna
(74) *Attorney, Agent, or Firm* — Keating & Bennett, LLP

(57) ABSTRACT

A developing device is equipped with a photoreceptor drum on which an electrostatic latent image is formed, a developing roller that supplies toner to the electrostatic latent image of the photoreceptor drum, a supply roller, a regulating roller, and a toner recovery unit that recovers at least toner adhering to the developing roller. The toner recovery unit includes a recovery member in which toner is recovered and which is disposed beneath the developing roller, the supply roller, and the regulating roller so as to be detachable.

19 Claims, 5 Drawing Sheets

DEVELOPING DEVICE AND IMAGE FORMING APPARATUS

BACKGROUND OF THE INVENTION

1. Field of the Invention

The present invention relates to a developing device and an image forming apparatus and particularly to a developing device equipped with a toner carrier to supply toner to an electrostatic latent image of an image carrier as well as an image forming apparatus equipped with this developing device.

2. Description of the Related Art

A developing device equipped with a toner carrier to supply toner to the electrostatic latent image of an image carrier has been known. See, for example, Japanese Patent Application Laid-Open Publication No. 2000-147889.

Japanese Patent Application Laid-Open Publication No. 2000-147889 discloses a developing device equipped with a photoreceptor on which the electrostatic latent image is formed, a developing roller for supplying toner to the electrostatic latent image of the photoreceptor, and a cleaning device for recovering toner adhering to the photoreceptor. This developing device is provided with a toner forced consumption mode by which, after it is determined that toner replenishment is required, the remaining toner is forcibly consumed. With this toner forced consumption mode, the constitution is such that the electrostatic latent image is forcibly formed on the photoreceptor, and the remaining toner is consumed by having the toner forcibly supplied to the electrostatic latent image of the photoreceptor via the developing roller. Then, the toner supplied to the photoreceptor is recovered by the cleaning device.

However, the developing device of Japanese Patent Application Laid-Open Publication No. 2000-147889 is constituted such that the electrostatic latent image is forcibly formed on the photoreceptor, and the remaining toner is forcibly supplied to the electrostatic latent image of the photoreceptor. Therefore, despite being unrelated to the printing operation, the electrostatic latent image is formed on the photoreceptor, and toner adheres to the photoreceptor, so there is a problem in that degradation of the photoreceptor is correspondingly faster.

SUMMARY OF THE INVENTION

Preferred embodiments of the present invention provide a developing device that prevents quick degradation of the image carrier and an image forming apparatus equipped with this developing device.

A developing device according to a preferred embodiment of the present invention includes an image carrier on which an electrostatic latent image is formed, a toner carrier that supplies toner to the electrostatic latent image of the image carrier, and a toner recovery unit that recovers at least toner adhering to the toner carrier, wherein the toner recovery unit includes a recovery member in which toner is recovered and which is disposed beneath the toner carrier so as to be detachable.

By providing a toner recovery unit that recovers toner adhering to the toner carrier as described above, it is not necessary to recover toner via the image carrier (photoreceptor), so at the image carrier, it is possible to prevent unnecessary electrostatic latent image formation and toner adhesion that are unrelated to the printing operation. This makes it possible to prevent faster degradation of the image carrier. Furthermore, by recovering toner that has adhered to the toner carrier with the toner recovery unit, it is possible to prevent toner which has already adhered once to the toner carrier (developing roller) but has not been supplied to the electrostatic latent image of the image carrier from adhering to the toner carrier again. In this way, it is possible to prevent the supply of toner to the image carrier in a state in which toner that has adhered to the toner carrier a plurality of times and degraded is mixed with toner that has not even once adhered to the toner carrier, so it is possible to significantly reduce or prevent uneven printing caused by a difference in the state of the toner.

Moreover, as a result of the toner recovery unit including a recovery member in which toner is recovered and which is disposed beneath the toner carrier so as to be detachable, the recovery member in which the toner is recovered can be removed to the outside, so toner can easily be recovered from the removed recovery member. Here, unlike the toner recovered from the image carrier (photoreceptor), the toner recovered from the toner carrier (developing roller) contains almost no foreign matter such as paper dust of the printing paper, for example. Consequently, the toner recovered from the toner carrier can be reused easily without performing any special process to remove foreign matter.

It is preferable that the recovery member have a structure which allows use as a toner cartridge that supplies toner to the toner carrier and be constituted such that recovered toner is supplied again to the toner carrier, thus allowing the toner to be reused. If such a constitution is adopted, the recovery member in which the toner is recovered can be used "as is" as a toner cartridge in which toner is stored, so it is not necessary to move the toner recovered in the recovery member to a separate toner cartridge. In this way, toner recovered from the toner carrier can be reused more easily.

It is preferable that the toner carrier include a developing roller, that the toner recovery unit be arranged at a position abutting the developing roller and further include a recovery roller which recovers toner adhering to the developing roller, and that the rotational speed of the recovery roller be lower than the rotational speed of the developing roller. When constituted in this manner, the recovery roller rotates while sliding on the surface of the developing roller, so the toner adhering to the developing roller can be scraped off by the recovery roller. Consequently, it is possible to recover the toner adhering to the developing roller. In addition, by having the rotational speed of the recovery roller be lower than the rotational speed of the developing roller, an increase in the rotational speed of the recovery roller can be prevented, so it is possible to prevent the recovery roller with a high rotational speed from rubbing forcefully with the developing roller. Consequently, scratches and the like do not occur easily on the surface of the developing roller, so degradation of the developing roller is reliably prevented.

In this case, the recovery roller preferably includes a sponge roller. By virtue of such a constitution, scratches or the like caused by the recovery roller occur even less easily on the surface of the developing roller, so it is possible to effectively prevent degradation of the developing roller.

The toner recovery unit is preferably constituted so as to constantly recover toner adhering to the toner carrier during printing. If such a constitution is adopted, the toner adhering to the toner carrier is constantly recovered during printing, so the toner that has already adhered once to the toner carrier but has not been supplied to the electrostatic latent image of the image carrier can be reliably prevented from again adhering to the toner carrier (developing roller).

It is preferable that a toner supply passage is further provided to supply toner to the toner carrier by being connected to the toner cartridge that supplies toner to the toner carrier, and that this device be constituted so as to perform a toner recovery operation to recover the toner remaining in the toner supply passage in the toner recovery unit when the toner cartridge is to be replaced. With such a constitution, after replacement of the toner cartridge, it is possible to prevent mixing of newly supplied toner with residual toner, so unevenness of printing caused by different toner states is significantly reduced or prevented.

It is preferable that a toner supply passage that supplies toner to the toner carrier is further provided, and that the toner recovery unit be constituted so as to be able to recover toner which drops from the toner supply passage. By virtue of such a constitution, even if toner drops from the toner supply passage, it can be recovered in the toner recovery unit, so toner can be reliably recovered while preventing an effect of dropped toner on other devices or the like.

The recovery member preferably includes a storage portion in which toner is recovered and a lid portion that is arranged at the opening of the storage portion and that can be opened and closed. If such a constitution is adopted, the lid portion makes it possible to prevent scattering of toner recovered in the storage portion from the storage portion.

An image forming apparatus according to a second preferred embodiment of the present invention is equipped with a developing device that includes an image carrier on which an electrostatic latent image is formed, a toner carrier that supplies toner to the electrostatic latent image of the image carrier, and a toner recovery unit that recovers at least toner adhering to the toner carrier, wherein the toner recovery unit includes a recovery member in which toner is recovered and which is disposed beneath the toner carrier so as to be detachable.

The developing device preferably is provided with a toner recovery unit that recovers toner adhering to the toner carrier as described above, thus eliminating a need to recover toner via the image carrier (photoreceptor), so it is possible to prevent unnecessary electrostatic latent image formation and toner adhesion that are unrelated to the printing operation at the image carrier. This makes it possible to prevent faster degradation of the image carrier. Furthermore, because the toner adhering to the toner carrier is recovered by the toner recovery unit, it is possible to prevent the toner that has already adhered once to the toner carrier (developing roller) but has not been supplied to the electrostatic latent image of the image carrier from again adhering to the toner carrier. In this way, it is possible to prevent the supply of toner to the image carrier in a state in which the toner that has adhered to the toner carrier a plurality of times and degraded is mixed with the toner that has not even once adhered to the toner carrier, so unevenness of printing caused by a difference in the toner state is significantly reduced or prevented.

Moreover, as a result of the toner recovery unit including a recovery member in which toner is recovered and which is disposed beneath the toner carrier so as to be detachable, the recovery member in which toner is recovered can be removed to the outside, so the toner can be easily recovered from the removed recovery member. Here, in contrast to the toner recovered from the image carrier (photoreceptor), the toner recovered from the toner carrier (developing roller) contains almost no foreign matter such as paper dust of the printing paper. Consequently, toner recovered from the toner carrier can be reused easily without performing any special process of removing foreign matter.

With various preferred embodiments of the present invention, it is possible to prevent faster degradation of the image carrier as described above.

The above and other elements, features, steps, characteristics and advantages of the present invention will become more apparent from the following detailed description of the preferred embodiments with reference to the attached drawings.

DETAILED DESCRIPTION OF PREFERRED EMBODIMENTS

Preferred embodiments of the present invention will be described below on the basis of the drawings.

The constitution of an image forming apparatus 100 according to a preferred embodiment of the present invention will be described with reference to FIGS. 1 through 4.

Figure 1:
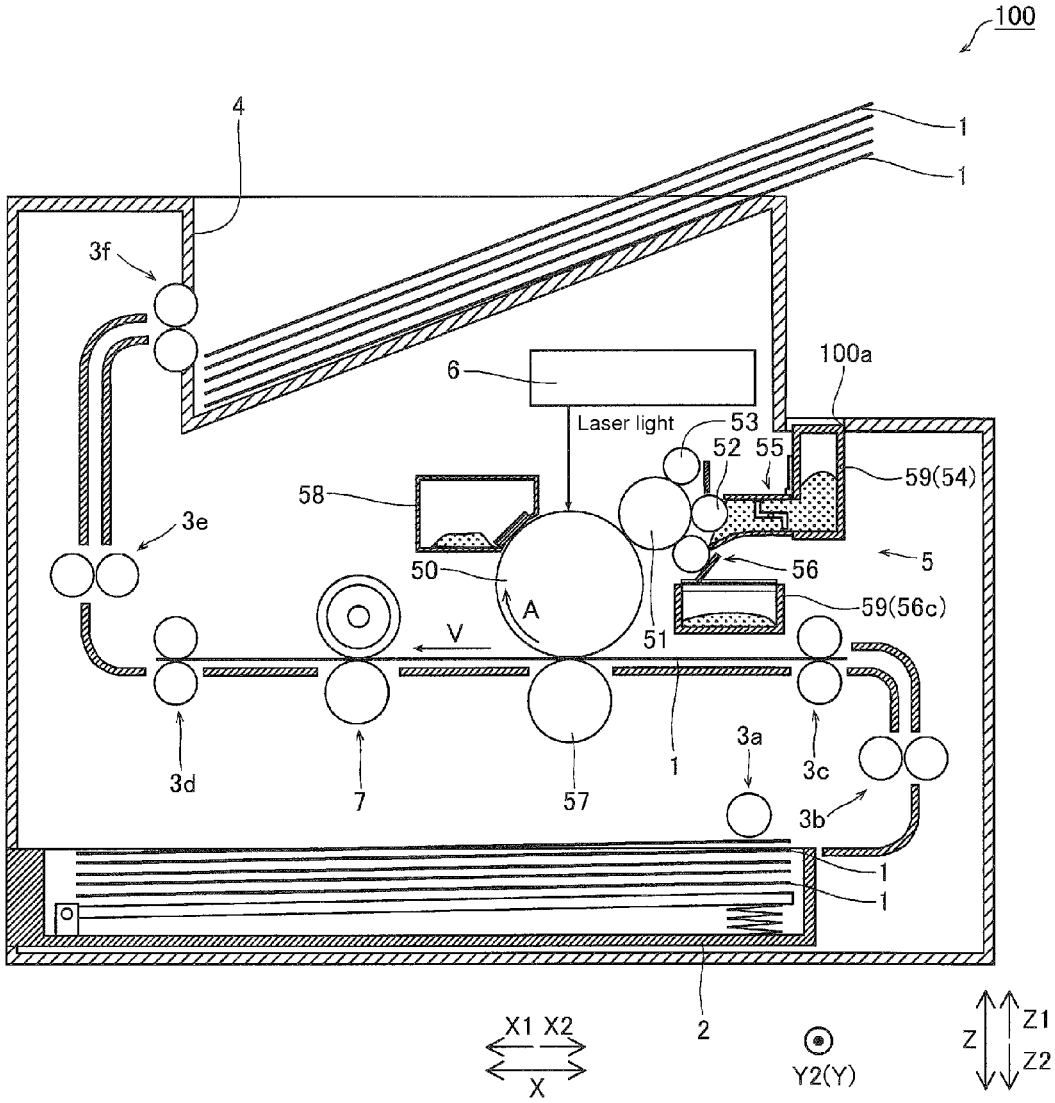
FIG. 1 is a model diagram showing the overall constitution of the image forming apparatus according to a preferred embodiment of the present invention.

As is shown in FIG. 1, the image forming apparatus 100 preferably is a so-called laser printer device which prints an image on printing paper 1 by using laser light to cause toner to adhere to the printing paper 1. Furthermore, the image forming apparatus 100 is equipped with a paper feed tray 2 in which printing paper 1 is loaded, a take-up roller 3*a* that conveys printing paper 1 from the paper feed tray 2, paper feed rollers 3*b* and 3*c* that convey printing paper 1 to the printing position, and conveying rollers 3*d* and 3*e* that convey printed printing paper 1. Note that the speed V of conveying the printing paper preferably is equal or substantially equal to the printing speed.

Moreover, the image forming apparatus 100 is equipped with a paper ejection tray 4 on which printed printing paper 1 is ejected and a paper ejection roller 3*f* that ejects the printing paper 1 to the paper ejection tray 4. In addition, the image forming apparatus 100 is equipped with a developing device 5 that prints on the printing paper 1, a laser light-emitting unit 6 that directs laser light onto a photoreceptor drum 50 of the developing device 5, and a heating roller 7 that fixes toner adhering to the printing paper 1.

As is shown in FIG. 1, the developing device 5 includes a photoreceptor drum 50 that performs printing by causing toner to adhere to the printing paper 1, a developing roller 51 that supplies toner to the photoreceptor drum 50, a supply roller 52 that supplies toner to the developing roller 51, and a regulating roller 53. Furthermore, the developing device 5 includes a toner cartridge 54 in which toner is stored, a toner supply passage 55 that supplies the toner of the toner cartridge 54 to the developing roller 51, the supply roller 52, and the regulating roller 53, and a toner recovery unit 56 that recovers toner from the developing roller 51 and the toner supply passage 55. Note that the photoreceptor drum 50 is an example of the "image carrier" according to a preferred embodiment of the present invention. Moreover, the developing roller 51, the supply roller 52, and the regulating roller 53 are examples of the "toner carrier" according to a preferred embodiment of the present invention.

In addition, the developing device 5 includes a transfer roller 57 that is disposed at a position facing opposite the photoreceptor drum 50 and that is used to transfer toner adhering to the photoreceptor drum 50 onto the printing paper 1 as well as a cleaning unit 58 that recovers toner remaining on the photoreceptor drum 50.

Furthermore, the toner is composed of fine particles, with color particles such as carbon being adhered to plastic particles that have been given a negative charge. As time elapses, or as this toner adheres to the photoreceptor drum 50, the developing roller 51, and the like, the negative charge (electric charge volume) becomes lower, and slight degradation occurs. Note that the toner is shown in the form of dots in FIGS. 1, 2, 5, and 6.

The photoreceptor drum 50 is constituted such that the surface thereof takes on a negative charge. Moreover, at the time of printing, at the photoreceptor drum 50, a specified surface of the photoreceptor drum 50 is first irradiated with the laser light from the laser light-emitting unit 6 along the clockwise rotation direction A of the photoreceptor drum 50, and the negative charge of the surface at the irradiated position is removed. Consequently, of the surface of the photoreceptor drum 50, an electrostatic latent image is created on the area from which the negative charge is removed. Afterward, the toner supplied by the developing roller 51 adheres to the electrostatic latent image of the photoreceptor drum 50. Then, as a result of the transfer roller 57 that takes on a positive charge moving the toner that takes on the negative charge from the photoreceptor drum 50 toward the transfer roller 57, the toner is adsorbed (transferred) on the printing paper 1 that is arranged between the transfer roller 57 and the photoreceptor drum 50. The constitution is such that as a result of this, printing is performed on the printing paper 1 based on the electrostatic latent image of the photoreceptor drum 50. Thereafter, at the photoreceptor drum 50, the negative charge on the surface is removed, after which the toner remaining on the surface is recovered by the cleaning unit 58. Finally, the constitution is such that a negative charge is again charged on the surface of the photoreceptor drum 50 by an electrode (not illustrated), and the printing operation is performed again.

Note that by passing through an area between the developing roller 51 and the photoreceptor drum 50 and between the photoreceptor drum 50 and the transfer roller 57, the toner recovered by the cleaning unit 58 has its electrical charge volume decreased and is degraded. In addition, the toner recovered by the cleaning unit 58 contains foreign matter such as paper dust of the printing paper 1 that has been mixed in while passing through between the photoreceptor drum 50 and the transfer roller 57. Therefore, in cases where toner recovered by the cleaning unit 58 is to be reused, not only does the electric charge state of the recovered toner need to be returned to the normal toner electrical charge state, but the mixed-in foreign matter also needs to be removed by using a classifier or the like. For this reason, the toner recovered by the cleaning unit 58 is generally discarded without being reused.

Figure 2:
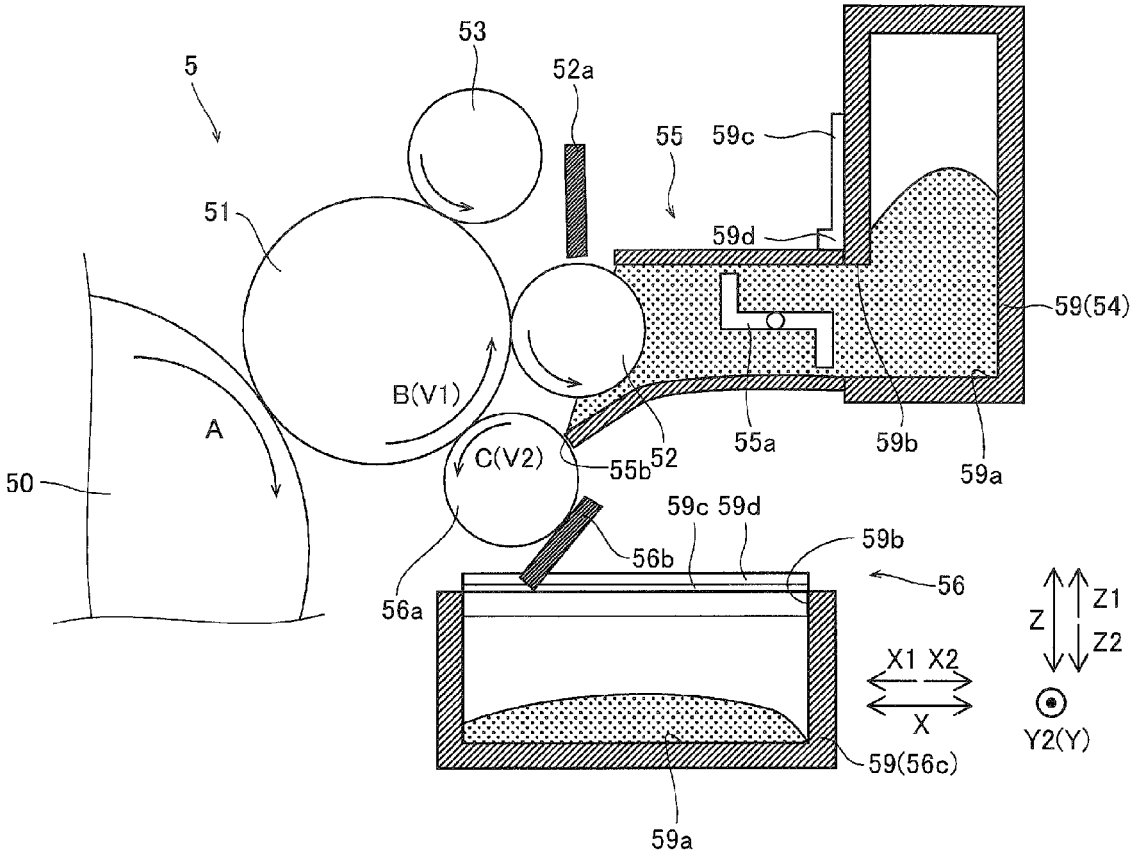
FIG. 2 is a model diagram showing the developing device of the image forming apparatus according to a preferred embodiment of the present invention.

The developing roller 51 takes on the negative charge and is also arranged so as to face opposite the photoreceptor drum 50 as shown in FIG. 2. Furthermore, the developing roller 51 is constituted so as to rotate in the counterclockwise rotation direction B at a rotational speed V1 based on the printing speed. Note that the rotation direction B of the developing roller 51 is the opposite direction to the rotation direction A of the photoreceptor drum 50.

The supply roller 52 and the regulating roller 53 are arranged so as to face opposite the developing roller 51. Moreover, the supply roller 52 is constituted so as to supply toner to the developing roller 51 in a state in which the toner adheres to the substantially entire surface. In addition, arranged above (Z1 side) the supply roller 52 is an electrode **52*a* that charges the supply roller 52 and thus causes sufficient toner to adhere to the supply roller 52. Furthermore, the regulating roller 53 has the function of regulating the thickness of the toner adhering to the developing roller 51** so as to be a specified thickness.

The toner supply passage 55 is connected to the toner cartridge 54 on the side opposite from the supply roller 52 (X2 side) and is constituted such that toner is supplied to the supply roller 52 as a result of the toner supplied from the toner cartridge 54 moving toward the side of the supply roller (X1 side). Moreover, provided inside the toner supply passage 55 is a fin **55*a*** that is constituted so as to be rotatable for the purpose of moving toner from the X2 side to the X1 side.

Here, in the present preferred embodiment, the toner recovery unit 56 is disposed beneath the developing roller 51, the supply roller 52, and the regulating roller 53 (Z2 side) and is arranged in order to recover toner adhering to the developing roller 51 as well as toner dropped from the toner supply passage 55. In addition, the toner recovery unit 56 includes a recovery roller **56*a* arranged so as to face opposite to the developing roller 51, a blade 56*b* that scrapes off toner adhering to the recovery roller 56*a* by contacting the recovery roller 56*a*, and a box-shaped recovery member 56*c* disposed beneath the recovery roller 56*a* and the blade 56*b***.

The recovery roller **56*a* preferably includes a sponge roller made of sponge and is arranged at a position abutting the developing roller 51. Furthermore, the recovery roller 56*a* is constituted so as to rotate in the rotation direction C (counterclockwise) which is the same as the rotation direction B of the developing roller 51. Consequently, the developing roller 51 and the recovery roller 56*a* move in directions opposite from each other in the portion where the developing roller 51 and the recovery roller 56*a* come into contact Therefore, the recovery roller 56*a* easily generates such a force that the toner adhering to the developing roller 51** is scraped off.

Moreover, the recovery roller **56*a* is constituted so as to rotate at a rotational speed V2 which is lower than the rotational speed V1 of the developing roller 51. Consequently, the recovery roller 56*a* is constituted so as to rotate while sliding on the surface of the developing roller 51. In addition, the recovery roller 56*a* is constituted so as to rotate accompanying the rotation of the developing roller 51 during printing. As a result, the constitution is such that toner adhering to the developing roller 51 is constantly recovered in the toner recovery unit 56** during printing.

The blade **56*b* is arranged beneath the X2 side of the recovery roller 56*a* (Z2 side) and is also arranged so as to tilt downward from the X2 side toward the X1 side (toward the side of the photoreceptor drum 50). Furthermore, the blade 56*b* is arranged to tilt such that toner that is scraped from the recovery roller 56*a* is guided to the recovery member 56*c*. Note that the blade 56*b* preferably is not provided so as to be detachable. Moreover, the recovery member 56*c* is arranged beneath the developing roller 51, the supply roller 52, and the regulating roller 53 (Z2 side) and also beneath the edge portion 55*b* on the X1 side of the toner supply passage 55 such that toner dropped from the edge portion 55***b* on the X1 side of the toner supply passage 55 is recovered.

Figure 3:
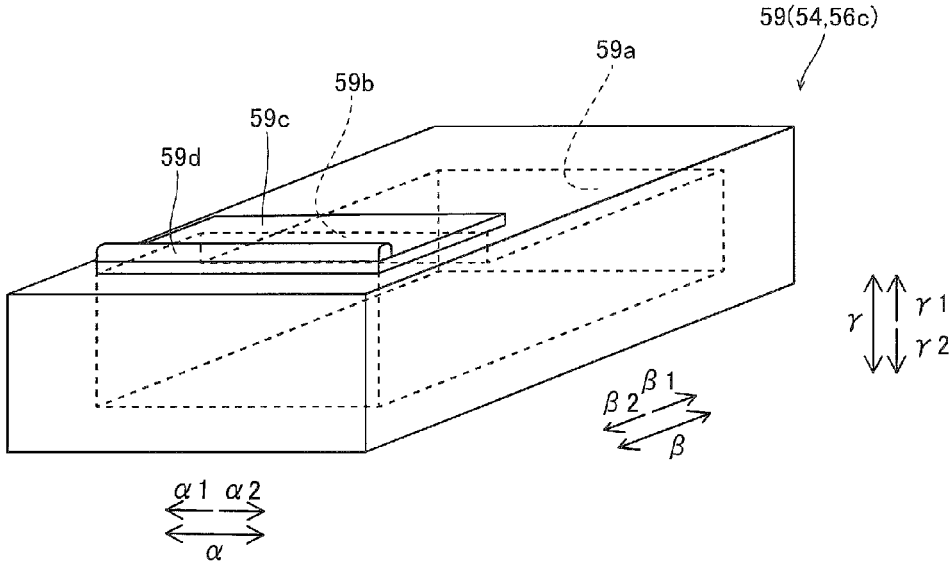
FIG. 3 is a perspective view showing the box-shaped member of the developing device of the image forming apparatus according to a preferred embodiment of the present invention.
Figure 4:
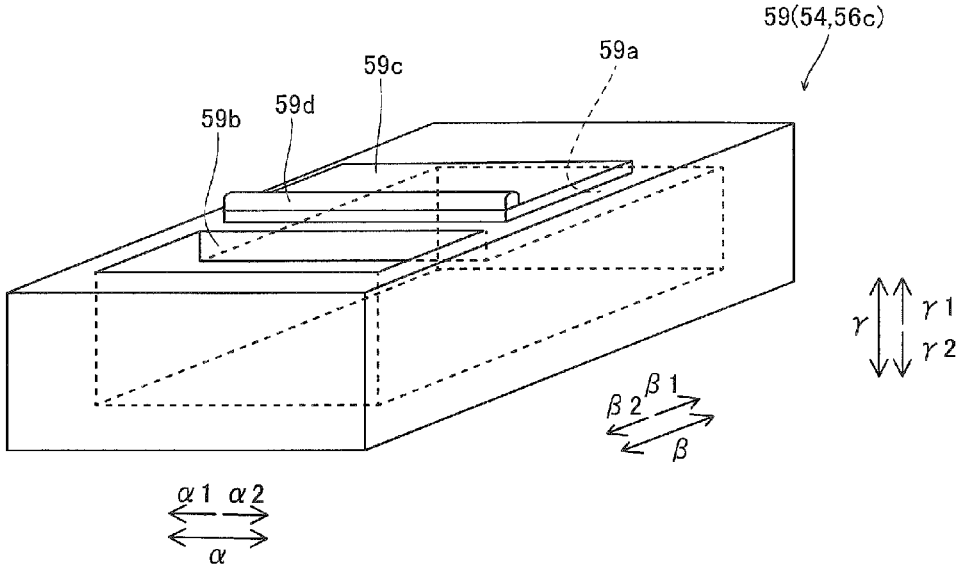
FIG. 4 is a perspective view showing a state in which the shutter portion is open in the box-shaped member of the developing device of the image forming apparatus according to a preferred embodiment of the present invention.

In addition, in the present preferred embodiment, the toner cartridge 54 and the recovery member 56*c* preferably include the same box-shaped member 59 having a rectangular or substantially rectangular solid shape. This allows the recovery member 56*c* to have a constitution that can be used as the toner cartridge 54. Furthermore, as is shown in FIG. 3 and FIG. 4, the box-shaped member 59 includes a storage portion 59*a* in which toner is stored and recovered as well as a shutter portion 59*c* which is arranged at an opening 59*b* of the storage portion 59*a* and which can open and close. Moreover, the shutter portion 59*c* has a projecting portion 59*d* projecting to the γ1 side and is also impelled in the β2 direction. In addition, the opening 59*b* of the storage portion 59*a* is provided in the γ1-side surface of the box-shaped member 59 and also on the β2 side. Note that the shutter portion 59*c* is an example of the "lid portion" according to a preferred embodiment of the present invention.

Here, in cases where the box-shaped member 59 is used as a toner cartridge 54, the constitution is such that the box-shaped member 59 is inserted into or removed from a cartridge insertion port 100*a* of the image forming apparatus 100 in the Z direction as shown in FIG. 1. That is, the toner cartridge 54 is constituted so as to be detachable. Furthermore, the box-shaped member 59 is constituted so as to be disposed inside the image forming apparatus 100 as the toner cartridge 54 in a state in which the β2-side surface of the box-shaped member 59 faces the Z2 direction and also in which the γ1-side surface faces the X1 direction.

Moreover, the box-shaped member 59 disposed inside the image forming apparatus 100 as the toner cartridge 54 as shown in FIG. 2 is constituted such that, at the time of attachment to the image forming apparatus 100, the shutter portion 59*c* is opened as a result of the upper surface of the toner supply passage 55 abutting the projecting portion 59*d*, and this exposes the opening 59*b* of the storage portion 59*a* as shown in FIG. 4. Meanwhile, the constitution of the box-shaped member 59 disposed as the toner cartridge 54 is such that, at the time of removal from the image forming apparatus 100, the shutter portion 59*c* that is impelled in the Z2 (β2) direction is automatically closed, so the opening 59*b* of the storage portion 59*a* is not exposed as shown in FIG. 3.

In addition, the box-shaped member 59 is constituted such that in cases where the box-shaped member 59 is used as the recovery member 56*c*, it is inserted into or removed from a recovery member insertion port (not illustrated) of the image forming apparatus 100 in the direction vertical to the plane of paper (Y direction). That is, the recovery member 56*c* preferably is constituted so as to be detachable. Furthermore, the box-shaped member 59 is constituted such that the box-shaped member 59 is disposed inside the image forming apparatus 100 as the recovery member 56*c* in a state in which the β2-side surface of the box-shaped member 59 faces the Y2 direction and also in which the γ1-side surface faces the Z1 direction.

Moreover, the box-shaped member 59 disposed inside the image forming apparatus 100 as the recovery member 56*c* is constituted such that, at the time of attachment to the image forming apparatus 100, the shutter portion 59*c* is opened by the blade 56*b* abutting the projecting portion 59*d*, and the opening 59*b* of the storage portion 59*a* is exposed as shown in FIG. 4. Meanwhile, the box-shaped member 59 disposed as the recovery member 56*c* is constituted such that, at the time of removal from the image forming apparatus 100, the shutter portion 59*c* impelled in the Y2 (β2) direction is automatically closed, and the opening 59*b* of the storage portion 59*a* is made not to be exposed as shown in FIG. 3.

Note that the toner recovered by the recovery member 56*c* has passed through only between the developing roller 51 and the photoreceptor drum 50, so the degree of degradation is low compared to the toner recovered by the cleaning unit 58. In addition, the toner recovered by the recovery member 56*c* has not passed through between the photoreceptor drum 50 and the transfer roller 57, so it contains almost no foreign matter such as paper dust of the printing paper 1. Therefore, the degree of degradation of the toner recovered by the recovery member 56*c* is low, so it is reusable.

Next, the task of exchanging the recovery member 56*c* and the toner cartridge 54 in the developing device 5 according to a preferred embodiment of the present invention will be described with reference to FIGS. 1, 2, 5, and 6.

Figure 5:
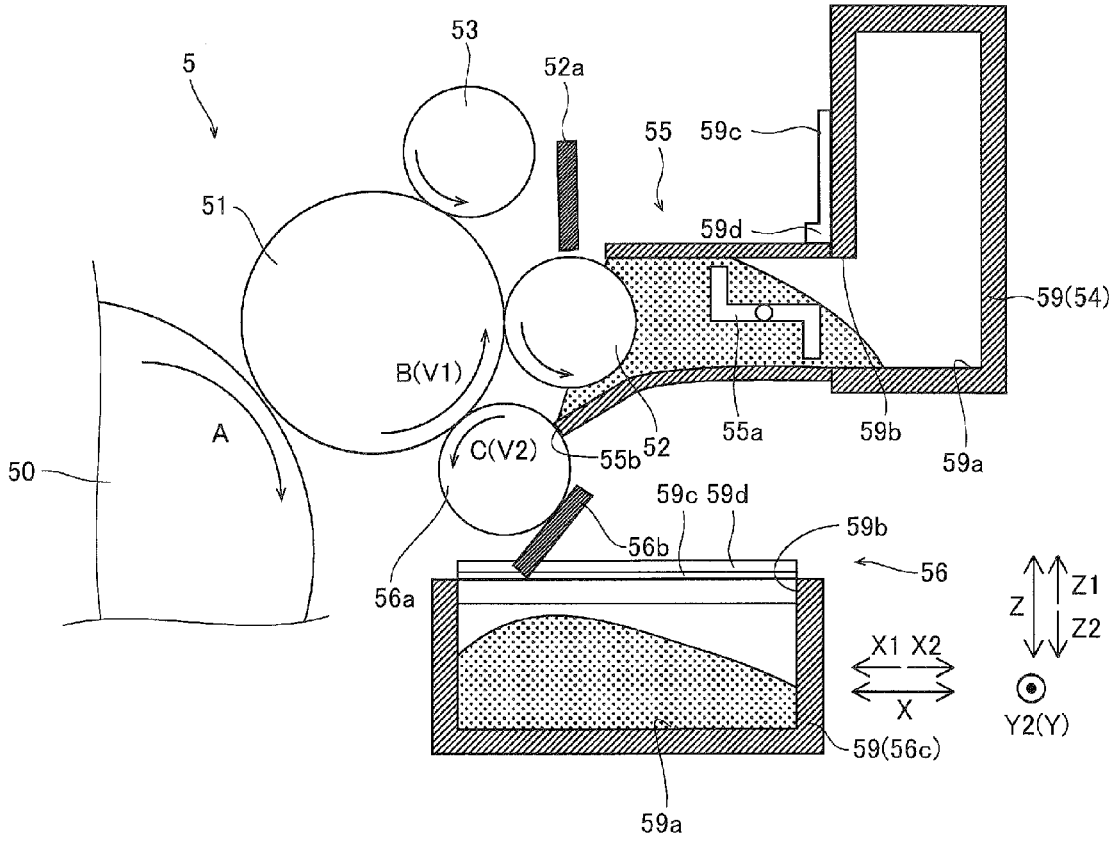
FIG. 5 is a model diagram showing a state before exchanging the recovery member and the toner cartridge of the developing device of the image forming apparatus according to a preferred embodiment of the present invention.

As is shown in FIG. 2, as a result of the printing task being performed with the image forming apparatus 100 (see FIG. 1), the fin 55*a* of the toner supply passage 55 is rotated, and the toner of the toner cartridge 54 is supplied to the supply roller 52. Then, the toner is supplied from the supply roller 52 to the developing roller 51, and the toner is supplied from the developing roller 51 to the electrostatic latent image of the photoreceptor drum 50. Therefore, the toner that remains on the developing roller 51 without having been supplied to the electrostatic latent image of the photoreceptor drum 50 is recovered to the recovery member 56*c* via the recovery roller 56*a* and the blade 56*b*. Furthermore, the toner that drops from the X1-side edge portion 55*b* of the toner supply passage 55 is also recovered. Then, when the toner of the toner cartridge 54 has almost run out as shown in FIG. 5, the user performs the task of exchanging the toner cartridge 54 and the recovery member 56*c*.

During the task of exchanging the toner cartridge 54 and the recovery member 56*c*, the box-shaped member 59 disposed as the toner cartridge 54 is removed from the cartridge insertion port 100*a* (see FIG. 1) of the image forming apparatus 100 in the Z1 direction. At this time, the shutter portion 59*c* is automatically closed by the impelling force, so the opening 59*b* of the storage portion 59*a* is not exposed. Moreover, the box-shaped member 59 disposed as the recovery member 56*c* is removed from the recovery member insertion port (not illustrated) of the image forming apparatus 100. At this time, the shutter portion 59*c* is automatically closed by the impelling force, so the opening 59*b* of the storage portion 59*a* is not exposed.

Then, the toner cartridge 54 and the recovery member 56*c* are exchanged. To with, the box-shaped member 59 disposed as the toner cartridge 54 is disposed as the recovery member 56*c*, and the box-shaped member 59 disposed as the recovery member 56*c* is disposed as the toner cartridge 54.

Figure 6:
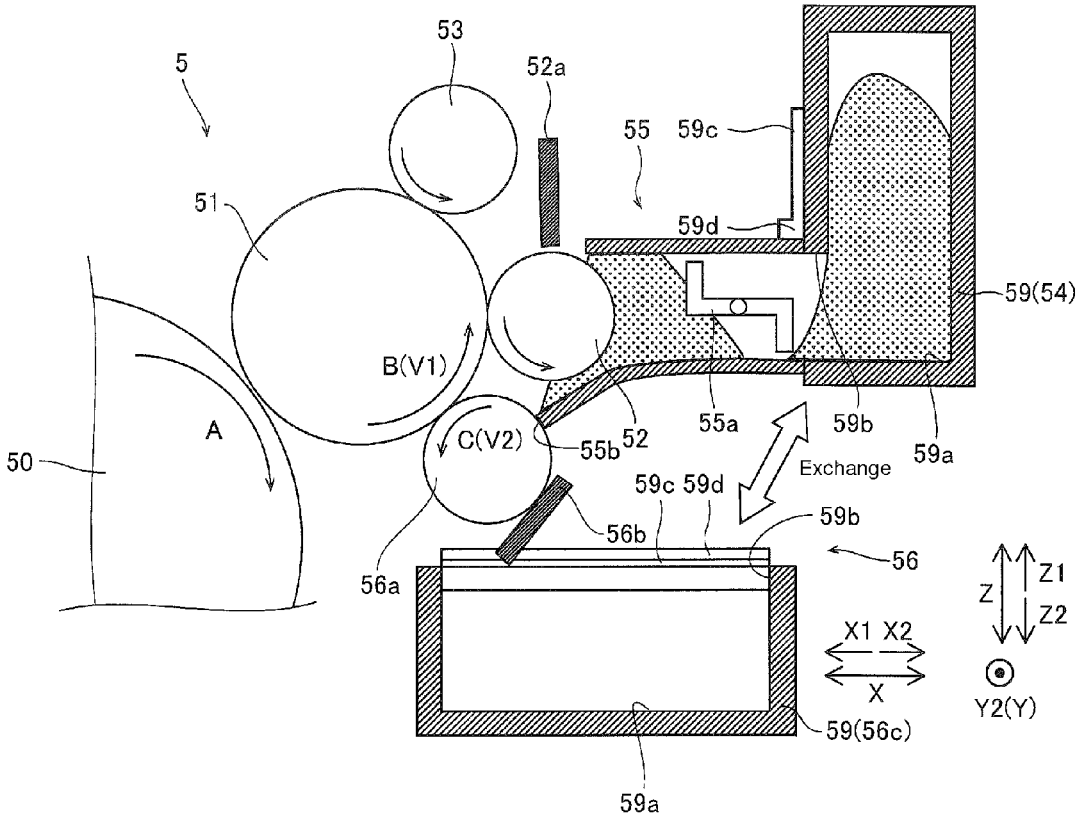
FIG. 6 is a model diagram showing a state after exchanging the recovery member and the toner cartridge of the developing device of the image forming apparatus according to a preferred embodiment of the present invention.

In specific terms, the box-shaped member 59 that was disposed as the recovery member 56*c* is inserted in the Z2 direction from the cartridge insertion port 100*a* of the image forming apparatus 100. At this time, as a result of the upper surface of the toner supply passage 55 abutting the projecting portion 59*d*, the shutter portion 59*c* is opened automatically, and the opening 59*b* of the storage portion 59*a* is exposed. Consequently, the toner stored in the storage portion 59*a* is supplied to the toner supply passage 55 as shown in FIG. 6. As a result, the toner recovered in the recovery member 56*c* is reused by being supplied again to the developing roller 51, the supply roller 52, and the regulating roller 53 via the toner supply passage 55.

In addition, the box-shaped member 59 that was disposed as the toner cartridge 54 is inserted in the Y2 direction from the recovery member insertion port (not illustrated) of the image forming apparatus 100. At this time, by the blade 56*b* abutting the projecting portion 59*d*, the shutter portion 59*c* is opened automatically, and the opening 59*b* of the storage portion 59*a* is exposed. As a result, the toner begins to be recovered to the storage portion 59*a* via the recovery roller 56*a* and the blade 56*b* as shown in FIG. 6.

Then, after the task of exchanging the toner cartridge 54 and the recovery member 56*c* (the task of replacing the toner cartridge 54) is performed, and before the printing operation is performed, the toner recovery operation is performed with the developing device 5. With this toner recovery operation, the developing roller 51, the supply roller 52, the regulating roller 53, and the recovery roller 56*a* are rotated a plurality of times, such that the toner remaining in the toner supply passage 55 is recovered to the recovery member 56*c* via the supply roller 52, the developing roller 51, the recovery roller 56*a*, and the blade 56*b*. Thereafter, the normal printing operation is performed.

In the present preferred embodiment, as was described above, by providing the toner recovery unit 56 that recovers toner adhering to the developing roller 51, there is no need to recover toner via the photoreceptor drum 50, so it is possible to prevent electrostatic latent image formation and toner adhesion unrelated to the printing operation from being performed unnecessarily at the photoreceptor drum 50. As a result, faster degradation of the photoreceptor drum 50 is prevented.

In the present preferred embodiment, furthermore, by recovering the toner adhering to the developing roller 51 with the toner recovery unit 56, the toner that has already adhered once to the developing roller 51 but has not been supplied to the electrostatic latent image of the photoreceptor drum 50 is prevented from adhering again to the developing roller 51. In this way, it is possible to prevent the supply of toner to the photoreceptor drum 50 in a state in which the toner degraded by adhering a plurality of times to the developing roller 51 is mixed with the toner that has not adhered even once to the developing roller 51. Therefore, it is possible to significantly reduce or prevent unevenness of printing caused by a difference in the toner state.

Moreover, in the present preferred embodiment, as a result of the recovery member 56*c* that is disposed beneath the developing roller 51, the supply roller 52, and the regulating roller 53 and also beneath the X1-side edge portion 55*b* of the toner supply passage 55 being constituted so as to be detachable, the recovery member 56*c* in which the toner is recovered is removed to the outside, so it is possible to easily recover toner from the removed recovery member 56*c*. Here, unlike the toner recovered from the photoreceptor drum 50, the toner recovered from the developing roller 51 contains almost no foreign matter such as paper dust of the printing paper 1. Consequently, toner recovered from the developing roller 51 can be reused easily without performing any special process of removing foreign matter.

In addition, in the present preferred embodiment, the constitution is such that the recovery member 56*c* can be used as the toner cartridge 54 and also such that the toner recovered in the recovery member 56*c* is reused by being supplied again to the developing roller 51, the supply roller 52, and the regulating roller 53 via the toner supply passage 55. This makes it possible for the recovery member 56*c* in which the toner is recovered to be used "as is" as the toner cartridge 54 in which toner is stored, so it is not necessary to move the toner recovered in the recovery member 56*c* to a different toner cartridge 54. Consequently, the toner recovered from the developing roller 51 can be reused more easily.

Furthermore, in the present preferred embodiment, by constituting the recovery roller 56*a* so as to rotate at a rotational speed V2 which is lower than the rotational speed V1 of the developing roller 51, the recovery roller 56*a* rotates while sliding on the surface of the developing roller 51, so toner adhering to the developing roller 51 is scraped off by the recovery roller 56*a*. This makes it possible to recover toner adhering to the developing roller 51. Moreover, because an increase in the rotational speed V2 of the recovery roller 56*a* is prevented, it is possible to prevent the recovery roller 56*a* with a high rotational speed V2 from rubbing forcefully on the developing roller 51. In this way, scratches or the like are not likely to occur on the surface of the developing roller 51, so it is possible to prevent degradation of the developing roller 51.

In addition, in the present preferred embodiment, as a result of the recovery roller 56*a* including a sponge roller, scratches or the like are less likely to occur on the surface of the developing roller 51 caused by the recovery roller 56*a*, so degradation of the developing roller 51 is effectively prevented.

Furthermore, in the present preferred embodiment, the toner recovery unit 56 is constituted such that toner adhering to the developing roller 51 is constantly recovered during printing, so it is possible to reliably prevent adhesion to the developing roller 51 of toner that has already adhered once to the developing roller 51 but has not been supplied to the electrostatic latent image of the photoreceptor drum 50.

Moreover, in the present preferred embodiment, the constitution is such that the toner recovery operation is performed with the developing device 5 after the task of exchanging the toner cartridge 54 and the recovery member 56 (task of replacing the toner cartridge 54) is performed, and before the printing operation is performed. This makes it possible to prevent the mixing of the newly supplied toner with the remaining toner after the toner cartridge 54 is replaced, so unevenness of printing caused by a difference in the toner state is significantly reduced or prevented.

In addition, in the present preferred embodiment, the recovery member 56*c* is disposed beneath the developing roller 51, the supply roller 52, and the regulating roller 53 and also beneath the X1-side edge portion 55*b* of the toner supply passage 55 so as to be able to recover toner that drops from the X1-side edge portion 55*b* of the toner supply passage 55. In this way, even if toner drops from the toner supply passage 55, it is recovered in the toner recovery unit 56, so it is possible to reliably recover toner while preventing an effect of the dropped toner on other devices or the like of the image forming apparatus 100.

Furthermore, in the present preferred embodiment, the box-shaped member 59 that is used as the recovery member 56*c* has the storage portion 59*a* in which toner is stored and recovered as well as the shutter portion 59*c* which is arranged at the opening 59*b* of the storage portion 59*a* and which can open and close, so the shutter portion 59*c* makes it possible to prevent scattering of toner recovered in the storage portion 59*a* from the storage portion 59*a*.

Note that the preferred embodiments disclosed herein merely constitute illustrative examples in all respects and should be considered to be nonrestrictive. The scope of the present invention is indicated not by the description of the preferred embodiments but rather by the scope of the claims, and it includes all modifications with an equivalent meaning to and within the scope of the patent claims.

For example, in a preferred embodiment described above, an example was shown in which the toner cartridge 54 and the recovery member 56*c* are composed of the same box-shaped member 59, but the present invention is not limited to this.

With the present invention, it is also possible to constitute the toner cartridge and the recovery member so as to be composed of different members. In this case, when toner recovered in the recovery member is to be reused, it is necessary to move the toner from the recovery member to the toner cartridge. Moreover, a constitution is also possible which is arranged such that a toner cartridge main body is newly provided separate from the toner cartridge composed of the box-shaped member, and the toner cartridge composed of the box-shaped member can be connected to the toner cartridge main body. This makes it possible to easily supply toner from the toner cartridge composed of the box-shaped member to the toner cartridge main body.

In addition, in a preferred embodiment described above, an example was shown in which the box-shaped member 59 used as the recovery member 56*c* has a rectangular or substantially rectangular solid shape, but the present invention is not limited to this. For instance, the box-shaped member can also be a shape such as a tube or a cylinder.

Furthermore, in a preferred embodiment described above, an example was shown in which the recovery roller 56*a* is arranged at a position abutting the developing roller 51, but the present invention is not limited to this. With the present invention, it is also possible to have the blade abut the developing roller without providing the recovery roller. Note that providing the recovery roller is more preferable than a case of not providing the recovery roller because it is less likely for scratches or the like to occur on the surface of the developing roller.

Moreover, in a preferred embodiment described above, an example was shown in which the blade 56*b* preferably is not detachable, but the present invention is not limited to this. With the present invention, it is also possible to have a constitution such that the blade and the recovery member are constituted as an integrated unit, thus making the blade and the recovery member integrally detachable.

In addition, in a preferred embodiment described above, an example was shown in which the rotational speed V2 of the recovery roller 56*a* preferably is lower than the rotational speed V1 of the developing roller 51, but the present invention is not limited to this. With the present invention, the rotational speed of the recovery roller may also be equal to or higher than the rotational speed of the developing roller.

Furthermore, in a preferred embodiment described above, an example was shown in which the recovery roller 56*a* is constituted so as to rotate in the same rotation direction C (counterclockwise) as the rotation direction B of the developing roller 51, but the present invention is not limited to this. With the present invention, it is also possible to have the rotation direction of the recovery roller be different from the rotation direction of the developing roller.

Moreover, in a preferred embodiment described above, an example was shown in which the toner recovery unit 56 is constituted so as to recover toner from the developing roller 51 and the toner supply passage 55, but the present invention is not limited to this. With the present invention, the toner recovery unit may also be constituted so as to recover toner only from the developing roller, without recovering toner from the toner supply passage. Alternatively, the toner recovery unit may also be constituted so as to recover toner not only from the developing roller and the toner supply passage but also recover toner from the supply roller and the regulating roller.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A developing device comprising:

an image carrier on which an electrostatic latent image is formed;

a toner carrier that supplies toner to the electrostatic latent image of the image carrier; and a toner recovery unit that recovers at least toner adhering to the toner carrier; wherein the toner recovery unit includes a recovery member in which toner is recovered and which is disposed beneath the toner carrier so as to be detachable, and the recovery member has a structure such that the recovery member is removable from the toner recovery unit and mountable in another location of the developing device to form a portion of a toner cartridge that supplies toner to the toner carrier.

2. The developing device according to claim 1, wherein the recovery member is configured to be used as the toner cartridge that supplies toner to the toner carrier such that recovered toner is supplied again to the toner carrier to allow the toner to be reused.

3. The developing device according to claim 1, wherein the toner carrier includes a developing roller;

the toner recovery unit is arranged at a position abutting the developing roller and further includes a recovery roller which recovers toner adhering to the developing roller; and a rotational speed of the recovery roller is lower than a rotational speed of the developing roller.

4. The developing device according to claim 3, wherein the recovery roller includes a sponge roller.

5. The developing device according to claim 1, wherein the toner recovery unit is configured to constantly recover toner adhering the toner carrier during printing.

6. The developing device according to claim 1, further comprising:

a toner supply passage that supplies toner to the toner carrier by being connected to the toner cartridge that supplies toner to the toner carrier; wherein the developing device is configured to perform a toner recovery operation to recover the toner remaining in the toner supply passage in the toner recovery unit when the toner cartridge is to be replaced.

7. The developing device according to claim 1, further comprising:

a toner supply passage that supplies toner to the toner carrier; wherein the toner recovery unit is configured to recover toner which drops from the toner supply passage.

8. The developing device according to claim 1, wherein the recovery member includes a storage portion in which toner is recovered and a lid portion that is arranged at an opening of the storage portion and that is configured to be opened and closed.

9. The developing device according to claim 1, wherein the toner cartridge has a structure that is identical or substantially identical to a structure of the recovery member.

10. The developing device according to claim 1, wherein the recovery member, includes a lid that is in a first position when mounted in the toner recovery unit, and when the recovery member is mounted in the another location of the developing device to form the portion of the toner cartridge that supplies toner to the toner carrier, the lid is in a second position.

11. An image forming apparatus comprising:

a developing device that includes:

an image carrier on which an electrostatic latent image is formed;

a toner carrier that supplies toner to the electrostatic latent image of the image carrier; and a toner recovery unit that recovers at least toner adhering to the toner carrier; wherein the toner recovery unit includes a recovery member in which toner is recovered and which is disposed beneath the toner carrier so as to be detachable, and the recovery member has a structure such that the recovery member is removable from the toner recovery unit and mountable in another location of the developing device to form a portion of a toner cartridge that supplies toner to the toner carrier.

12. The image forming apparatus according to claim 11, wherein the recovery member is configured to be used as the toner cartridge that supplies toner to the toner carrier such that recovered toner is supplied again to the toner carrier to allow the toner to be reused.

13. The image forming apparatus according to claim 11, wherein the toner carrier includes a developing roller;

the toner recovery unit is arranged at a position abutting the developing roller and further includes a recovery roller which recovers toner adhering to the developing roller; and a rotational speed of the recovery roller is lower than a rotational speed of the developing roller.

14. The image forming apparatus according to claim 13, wherein the recovery roller includes a sponge roller.

15. The image forming apparatus according to claim 11, wherein the toner recovery unit is configured to constantly recover toner adhering the toner carrier during printing.

16. The image forming apparatus according to claim 11, wherein the developing device further includes:

a toner supply passage that supplies toner to the toner carrier by being connected to the toner cartridge that supplies toner to the toner carrier; wherein the developing device is configured to perform a toner recovery operation to recover the toner remaining in the toner supply passage in the toner recovery unit when the toner cartridge is to be replaced.

17. The image forming apparatus according to claim 11, wherein the developing device further includes:

a toner supply passage that supplies toner to the toner carrier; wherein the toner recovery unit is configured to recover toner which drops from the toner supply passage.

18. The image forming apparatus according to claim 11, wherein the recovery member includes a storage portion in which toner is recovered and a lid portion that is arranged at an opening of the storage portion and that is configured to be opened and closed.

19. A developing device comprising:

an image carrier on which an electrostatic latent image is formed;

a toner carrier that supplies toner to the electrostatic latent image of the image carrier; and a box-shaped member mountable in first and second locations in the developing device; wherein when the box-shaped member is mounted in the first location, the box shaped member forms a portion of a toner recovery unit that recovers at least toner adhering to the toner carrier, and when the box-shaped member is mounted in the second location, the box shaped member forms a portion of a toner cartridge that supplies toner to the toner carrier.

* * * * *